US007900787B2

(12) United States Patent
Oh et al.

(10) Patent No.: US 7,900,787 B2
(45) Date of Patent: Mar. 8, 2011

(54) CAPSULE TOOL

(76) Inventors: Dong-Gie Oh, Iksan-Si (KR); Jeong-Min Kim, Jeonju-Si (KR)

( * ) Notice: Subject to any disclaimer, the term of this patent is extended or adjusted under 35 U.S.C. 154(b) by 1216 days.

(21) Appl. No.: 10/592,165

(22) PCT Filed: Aug. 20, 2004

(86) PCT No.: PCT/KR2004/002094

§ 371 (c)(1),
(2), (4) Date: Sep. 8, 2006

(87) PCT Pub. No.: WO2005/085088

PCT Pub. Date: Sep. 15, 2005

(65) Prior Publication Data

US 2007/0199838 A1 Aug. 30, 2007

(30) Foreign Application Priority Data

Mar. 8, 2004 (KR) ..... 10-2004-0015643
Jun. 7, 2004 (KR) ..... 10-2004-0041386

(51) Int. Cl.
*B65D 1/04* (2006.01)

(52) U.S. Cl. ..... 215/6; 206/222; 220/277; 215/250

(58) Field of Classification Search ..... 206/219, 206/221, 222; 220/277; 215/6, DIG. 8, 250, 215/257

See application file for complete search history.

(56) References Cited

U.S. PATENT DOCUMENTS 3,156,369 A * 11/1964 Bowes et al. ..... 206/222
3,347,410 A * 10/1967 Schwartzman ..... 222/80
3,521,745 A * 7/1970 Schwartzman ..... 206/222
3,603,469 A * 9/1971 Magni ..... 206/222
3,840,136 A * 10/1974 Lanfranconi et al. ..... 215/6
4,858,760 A * 8/1989 Di Sturco ..... 206/222
4,903,865 A * 2/1990 Janowitz ..... 222/83.5
5,029,718 A * 7/1991 Rizzardi ..... 215/254
5,038,951 A * 8/1991 Rizzardi ..... 215/256
5,255,812 A * 10/1993 Hsu ..... 220/277
5,543,097 A * 8/1996 Fang ..... 264/102
5,735,320 A * 4/1998 Tune et al. ..... 141/330

(Continued)

FOREIGN PATENT DOCUMENTS

JP 210270 1/1990

(Continued)

OTHER PUBLICATIONS

International Search Report; corresponding application No. PCT/KR2004/002094; Date: Dec. 29, 2004.

(Continued)

*Primary Examiner* — Anthony Stashick
*Assistant Examiner* — Christopher B McKinley
(74) *Attorney, Agent, or Firm* — Cantor Colburn LLP

(57) ABSTRACT

Capsule containers disclosed in the present invention. In principle, the capsule container is accommodated inside of the opening formed in a common container such as a beverage container, bucket container, etc. and caught and supported by the rim of the opening. The capsule container is advantageous in that it enables blending of the content accommodated inside with a fluid, powder, etc. having different properties as intended by the user; safe blending of contents without flowing-out; and prevention of excessive flow-out of contents as only proper amounts of the contents are discharged through the opening when the contents flow out.

17 Claims, 7 Drawing Sheets

U.S. PATENT DOCUMENTS

| | | | | |
|---|---|---|---|---|
| 5,984,141 | A * | 11/1999 | Gibler | 222/80 |
| 6,073,803 | A * | 6/2000 | Sturm et al. | 222/80 |
| 6,152,296 | A * | 11/2000 | Shih | 206/222 |
| 6,305,576 | B1 * | 10/2001 | Leoncavallo | 222/83.5 |
| 6,609,612 | B2 * | 8/2003 | Vlodek | 206/222 |
| 6,786,330 | B2 * | 9/2004 | Mollstam et al. | 206/222 |
| 6,908,011 | B2 * | 6/2005 | Cho | 222/83 |
| 6,926,138 | B1 * | 8/2005 | Basham et al. | 206/222 |
| 6,959,839 | B2 * | 11/2005 | Roth et al. | 222/83 |
| 7,568,576 | B2 * | 8/2009 | Sweeney et al. | 206/219 |
| 2002/0179461 | A1 * | 12/2002 | Mollstam et al. | 206/222 |
| 2004/0149599 | A1 * | 8/2004 | Cho | 206/219 |
| 2004/0200741 | A1 * | 10/2004 | Cho | 206/219 |

FOREIGN PATENT DOCUMENTS

| | | |
|---|---|---|
| KR | 20-170710 | 11/1999 |
| KR | 20-0259252 | 12/2001 |
| KR | 20-0261338 | 1/2002 |
| KR | 200439227 | 5/2004 |
| KR | 200356836 | 7/2004 |

OTHER PUBLICATIONS

International Preliminary Examination Report; corresponding application No. PCT/KR2004/002094; Date: Sep. 13, 2006.
All the references cited in the Search Report are listed above.

* cited by examiner

CAPSULE TOOL

TECHNICAL FIELD

The present invention is related to capsule containers, more particularly, capsule containers capable of diluting drinkables or blending chemical substances according to how they are used. They are inserted into the inner parts of various kinds of the conventional containers in the state that fluids, powder, etc. having different properties from those of the contents in the containers are accommodated.

BACKGROUND ART

As is generally known, the conventional beverage containers or containers accommodating chemical substances, etc. are constructed to accommodate a single beverage or chemical substance. In more detail, since the insides of the conventional beverage containers (for example, beverage bottles having openings with small inner diameters at their upper ends, etc.) have been constructed to accommodate single-tasted or -flavored beverages, water, etc., it has not been possible to produce various tastes and flavors.

In order to solve the above problem, several solutions have been proposed including Korean Utility Model Publication No. 20-0170710 entitled "Beverage containers containing various kinds of original beverage solutions" (hereinafter referred to as Prior Art 1), Korean Utility Model Publication No. 20-0261338 entitled "Beverage containers having pressurized original solution containers built in" (hereinafter referred to as Prior Art 2), and Korean Utility Model Publication No. 20-0259252 entitled "Caps of natural water bottles having beverage powder or tea bags built in" (hereinafter referred to as Prior Art 3).

The containers in the above-described Prior Art 1 and Prior Art 3 have the construction and operational effects that heterogeneous substances are divided and contained separately but kept in one container without being mixed at ordinary times, but are mixed and taken as intended by the user.

However, the containers in Prior Art 1 have been problematic in that it has not been possible to offer a low cost of manufacture and to manage sanitarily and refill a multiple number of auxiliary containers accommodating the original solutions since they have had complicated structures and have been aimed to accommodate many kinds of original solutions, which could have been blended selectively by the user.

As to the containers disclosed in Prior Art 2, the cap combined with the main body of a container is comprised of the first cap and the second cap. The first cap is provided with a double helix at the portion corresponding to the container body. The first cap is threadedly engaged to the container body in the state that it is threadedly engaged to the upper side of the second cap. While the cap is open when the user drinks natural water, the first cap and the second cap are separated, if necessary, in order for the user to put a tea bag or beverage powder built in the second cap into the container body and blend them therein. However, since the first cap should be provided with a double helix as described in the above, its construction is complicated. Also, when the user drinks blended drinkables, the second cap should be released from the first cap, the contents in the second cap should be input into the container body and blended, and finally, the first cap and the second cap should be again threadedly engaged making their operation complicated. Further, in order to perform the above steps, the user should grip the container body, the first cap, and the second cap, making its use inconvenient. Still further, if not enough care is taken when the contents in the second cap are input into the container body, the contents may flow out of the container body.

It is seen that the containers in Prior Art 3 have complicated structures. They are comprised of a container, a cap engaged to the container, an original solution container engaged to the lower end of the cap, a cutting blade formed at the lower end of the cap to cut a certain portion of the upper part of the original solution container, a push button passing vertically through the central part of the cap, and a cover finishing the upper side of the cap. These containers are operated in such a way that, after the cover is separated from the cap, if the push button is pushed down, the lower side of the push button presses the cutting blade to widen the side portion, and thus cuts a portion of the original solution container adjacent to the side portion; and the original solution flows out through the cut portion by the pressure of the drinkable accommodated in the container and blended with the drinkable. Accordingly, Prior Art 3 performs the above-described blending action in the state that a fixed amount of fluid pressure is applied to the original solution container by the drinkable accommodated in the container. Therefore, actually, the containers according to Prior Art 3 have been disadvantageous in that only the beverages that have been the mixture of drinkables and original solutions have been applicable; it has not been possible to offer a low cost of manufacture; and they have been disposable making it difficult to demonstrate sufficiently the operational effects corresponding to the complicated structure described in the above.

As described in the above, since the containers in Prior Art 1 and Prior Art 3 have been constructed to be used only for beverage bottles, their use has been limited and it has not been possible to apply them to various areas.

In the meantime, the conventional bucket containers have been used to accommodate chemical substances (for example, paints, etc.). More concretely, a bucket container has been comprised of a bucket-shaped container body with a closed inner part, an opening formed on the container body, and a cover for opening or closing of the opening. Described below is the conventional bucket container taking a paint as the chemical substance accommodated in the bucket container as an example for the sake of convenience:

In using the conventional bucket containers accommodating water- or oil-based paints, in order to implement a proper concentration and a desired color, the paint should be diluted by using solvents such as a thinner, etc., or water. Conventionally, dilution should be performed by taking a fixed amount of the paint to a separate container after opening the cap of a bucket container. In these cases, there have been problems that the material accommodated in the container flows out to the outside due to a difference in atmospheric pressure or temperature when opening the cap, thus contaminating the worker and/or working environment. Also, there have been other problems that a separate container for dilution should have been equipped with since the dilution of the paint should have been done in a separate container different from the bucket container, a fixed amount of the diluted paint has still remained in the container after the painting work has been completed generally, which has been disposed at once producing a large amount of contaminated materials causing environmental contamination.

DISCLOSURE OF THE INVENTION

Therefore, an object of the present invention is to solve the problems involved in the prior art, and to provide with capsule containers accommodated in beverage containers and/or bucket containers, in which the capsule containers are supported by the rim of an opening provided at the beverage container and bucket container.

Another object of the present invention is to provide with a capsule container capable of effectively using two kinds of contents, in which the content contained in a beverage container or a bucket container is used at ordinary times, but the content contained in the capsule container is mixed with the content contained in the beverage container or the bucket container as intended by the user.

Still another object of the present invention is to provide with a capsule container capable of not only preventing the content from splashing or flowing-out to the outside when opening the cap of a beverage container and/or bucket container, drinking, or taking-out the content from the container but also adjusting the amount of flow-out when drinking or taking-out the content.

Yet another object of the present invention is to provide with capsule containers by making capsule containers in the form of modules so that the contents in one or more capsule containers may be blended with the contents accommodated in beverage containers and/or bucket containers at a specific ratio as intended by the manufacturer.

In order to achieve the above objects, there is provided with a capsule container comprised of a cylindrical receiving member with both ends open; a partition extended inwardly from the portion of an inner periphery of the receiving member to divide the receiving member into upper and lower portions; one or more discharging ports penetrating at regular intervals through the side wall of the receiving member located on or above the partition; an inverted-cup-shaped pressing member extended upwardly from a portion of the partition in a fixed length; a vertically movable member extended downwardly from the inner upper side of the pressing member in a fixed length having a point at the lower end; and a shielding membrane finishing the lower side of the receiving member, in which the receiving member is inserted into and supported by the opening of the conventional container.

Preferably, the portion of the pressing member encountered with the vertically movable member is made of a material selected from the materials having a fixed amount of elastic stability.

The capsule container may further include a hollow portion vertically penetrating through the central portion of the partition; a cylindrical guide member extended upwardly from the partition or an inner periphery of the hollow portion; and a vertically movable member, separately from the receiving member, which is inserted into the hollow portion, supported by the guide member to be able to slide up and down, and equipped with a pressing member on its upper side.

The capsule container may be further equipped with a locking portion extended from the upper side of the receiving member; and a guide end having an inner periphery that comes in contact with the outer periphery of the guide member, as the upper side of the pressing member is made to have the same shape and size as those of the outer periphery of the guide member.

In this case, the partition may be curved and streamlined from the discharging port. And the vertically movable member may be inverted-cup-shaped, where the lower end is open and the other side is closed, thereby forming a space part therein, and the lower end is equipped with the above point.

And the upper side of the guide member may be cut to have fixed thickness and height, and thus, equipped with an enlarged end and a stepped portion. The pressing member is further equipped with a locking portion, which is caught and supported by the stepped portion when it moves down since its upper side is horizontally extended to have the same size as that of the enlarged end.

In the meantime, the inner periphery of the guide end and the outer periphery of the vertically movable member, or the outer periphery of the guide member and the inner periphery of the guide member corresponding to the above, may be equipped with a concave portion and the corresponding convex portion. And the shielding membrane is a thin film made of aluminum, or one or more materials selected from synthetic resins, or one or more synthetic resins layered.

Along with the above, it is preferable to accommodate one or more components selected from solid powder, liquid, and gas having different components in the space part, between the partition of the receiving member and the shielding membrane, and the containers.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

Reference will now be made in detail to preferred embodiments of the present invention, examples of which are illustrated in the accompanying drawings.

Preferred Embodiment 1

Figure 1:
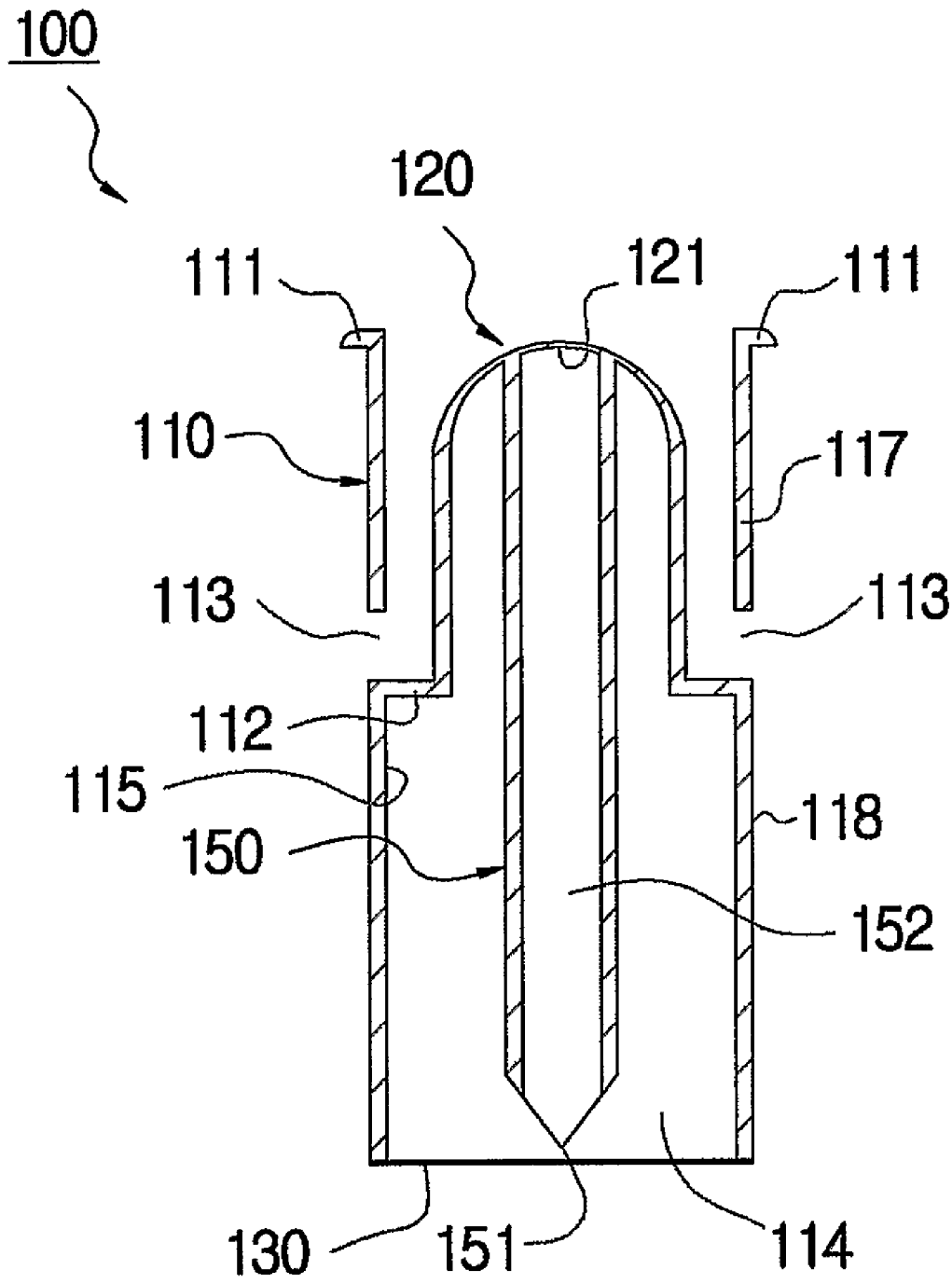
FIG. 1 is a cross-sectional view of a capsule container according to the present invention.
Figure 2:
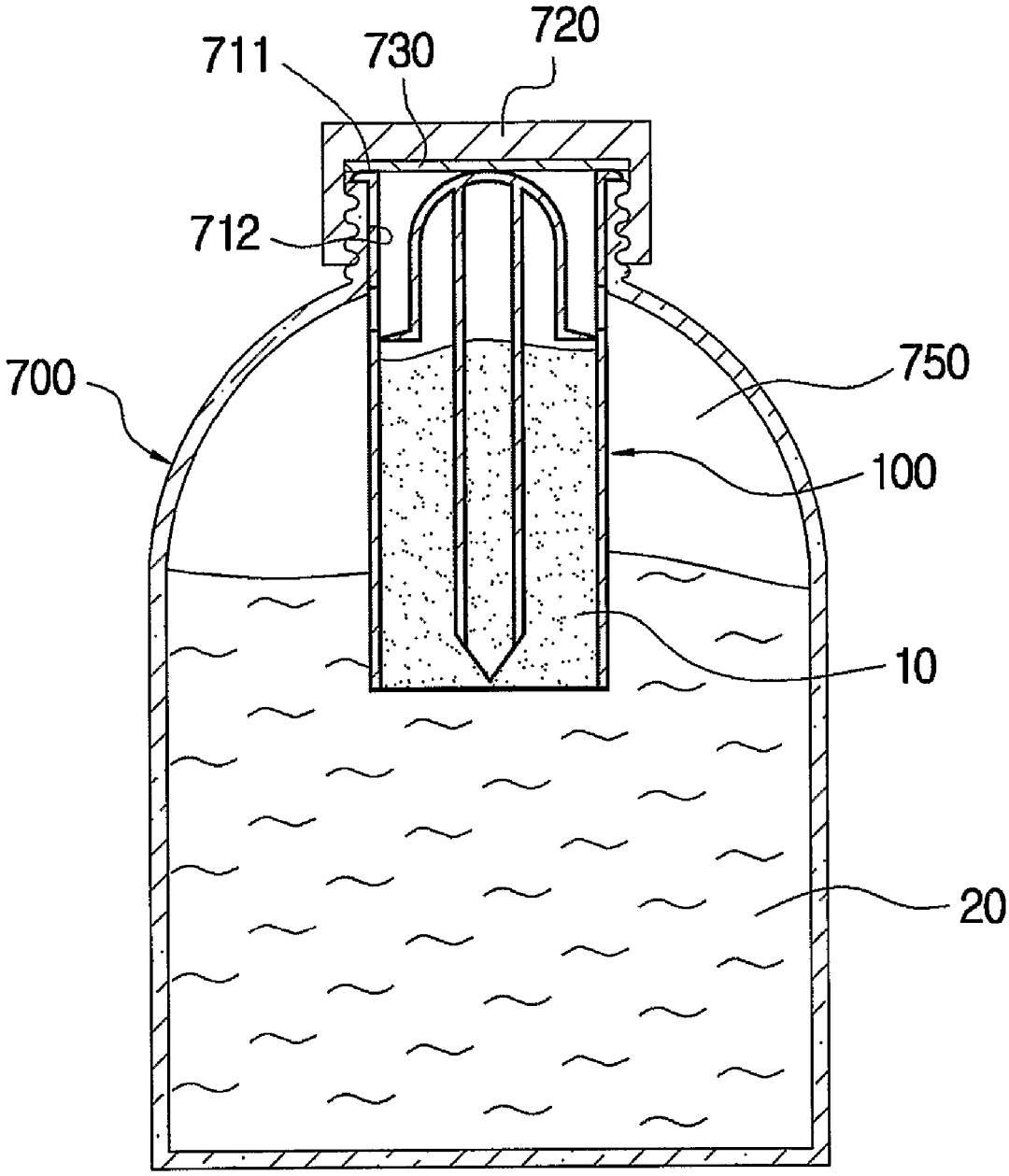
FIG. 2 is a cross-sectional view of the capsule container shown in FIG. 1 assembled to a beverage bottle.
Figure 3:
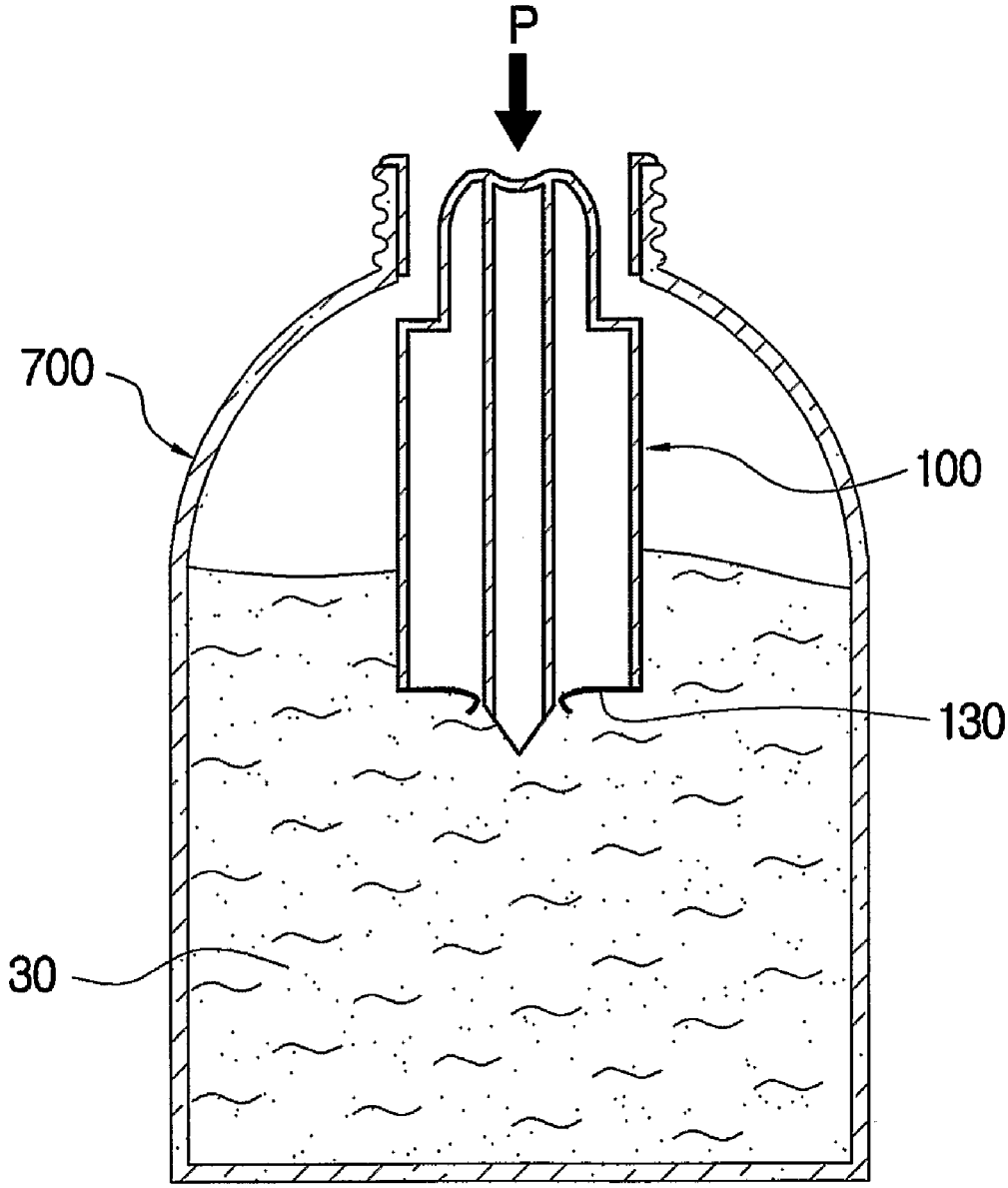
FIG. 3 is a cross-sectional view of the capsule container shown in FIG. 2 when it is used.

FIG. 1 is a cross-sectional view of a capsule container 100 according to the present invention. FIG. 2 is a cross-sectional view of the capsule container 100 shown in FIG. 1 assembled to a beverage bottle 700. FIG. 3 is a cross-sectional view of the capsule container shown in FIG. 2 when it is used.

Referring now to FIGS. 1 to 3, the capsule container 100 according to the present invention includes a receiving member 110, a pressing member 120 integrally formed on the inner periphery of the receiving member 110, a vertically movable member 150 installed inside of the pressing member 120, and a shielding membrane 130 finishing the lower side of the receiving member 110.

More concretely, the receiving member 110 has a cylindrical shape having both ends open, and the outer periphery 118 of the receiving member 110 has the same diameter and shape as those of the inner periphery 712 of the opening formed on a bottle 700. The upper side of the receiving member 110 is laterally extended to form a locking portion 111 which is caught and supported by the rim 711 of the opening. The receiving member 110 is provided with a plurality of discharging ports 113 penetrating through the side wall 117 of the receiving member 110 at regular intervals.

In the meantime, as shown in FIGS. 1 through 3, the pressing member 120 includes a partition 112 extended inwardly from a portion of the inner periphery 115 of the receiving member 110 under the discharging ports 113 to divide the receiving member 110 into upper and lower portions, and has an inverted cup shape extended upwardly from the partition 112 to the upper side of the locking portion 111.

As described in the above, the pressing member 120 also includes a vertically movable member 150 extended downwardly from the inner upper side 121 of the pressing member 120 in a fixed length to be equipped with a point 151 at the lower end thereof. The point 151 has a length shorter than that of the lower end of the receiving member 110.

Therefore, the capsule container 100 according to the present invention is advantageous in that it has a less cost of manufacture through injection molding, etc. since the receiving member 110, pressing member 120, and vertically movable member 150 are formed integrally.

The operational principle of the capsule container 100 will now be described in detail with reference to FIGS. 2 and 3.

In principle, the capsule container 100 is inserted into the opening formed on the neck of a common bottle 700 containing a beverage or another substance, where the locking portion 111 is caught and supported by a rim 711 forming the opening.

Different contents are accommodated in a space part 114, formed between the shielding membrane 130 and the partition 112 of the receiving member 110, and the receiving part 750 of the bottle 700. For instance, if the bottle 700 including the capsule container 100 is used to contain a beverage, accommodated in the receiving part 750 of the bottle 700 is a content 20, such as water, carbonated beverage, milk, ionic beverage, health beverage, various kinds of drugs supplied through pharmaceutical companies, tonic water, etc. And accommodated in the space part 114 is another content, such as the original solution of a medicinal herb, original solution of a juice, original solution of a carbonated beverage such as coke, etc., infant food, alcoholic beverage such as whisky, etc., that may be readily diluted with the above content 20.

Alternatively, if the bottle 700 including the capsule container 100 is used for blending in a chemical reaction, accommodated in the receiving part 750 and the space part 114 of the bottle 700 are a proper amount of a chemical substance (for example, an agricultural chemical, original chemical synthesis material, etc.) to be blended.

Hereinafter, the present invention is illustrated in detail assuming that the bottle 700 accommodating the capsule container is for beverages for the sake of convenience in description.

As typical containers do, the bottle includes a lid 720 for opening or closing an opening formed on the upper side, and a sealing member 730 of a flexible material on the inner upper side of the lid 720 for pressurized sealing of the upper side of the locking portion 111 and the rim 711 of the opening. In case of bottles 700 including such capsule container 100, if a user wants to drink the content accommodated in the bottle 700 at ordinary times, the user separates the lid 720 from the bottle 700 and drinks the content in the usual method.

At this time, air pressure is applied to the receiving part 750 through the discharging ports 113 formed on the receiving member 110, and the content 20 is discharged through the discharging ports 113 when the user drinks the content 20. Since the content 20 is discharged in an amount corresponding to the size of diameter and number of the discharging ports 113, it can prevent excessive flow-out of the content not contaminating the clothes of the user.

When the user wants to drink the mixture of the content 10 accommodated in the space part 114 of the capsule container 100 and the content 20 accommodated in the bottle 700, the user applies a fixed amount of pressure P to the pressing member 120.

The portion of the pressing member 120 on which the vertically movable member 150 is formed has a thickness and is made of a material that can allow elastic stability. When the pressure P is applied to the portion, as shown in FIG. 3, the portion is transformed to move the vertically movable member 150 downwardly, and thus, break the shielding membrane 130. After that, if the pressure P is released, the vertically movable member 150 is restored to its original position. Accordingly, the content 10 accommodated in the space part 114 flows into the bottle 700, and the contents 10 and 20 are blended.

The user can drink the completely blended content 30 after maximizing blending by shaking the bottle 700 in the state that the opening of the bottle 700 is closed by using the lid 720.

Preferably, formed on the outer periphery 118 of the receiving member 110 is a graduated gauge that enables recognition of the amount of the content of the receiving part 750, so that the content 20 in the receiving member 110 is drunk or withdrawn at ordinary times but is diluted or blended through the above capsule container 100 as intended by the user. If the bottle 700 and/or receiving member 110 is used for beverages, blending chemical substances, etc., it is preferable to implement them with transparent or semi-transparent material so that the blending action such as a chemical reaction, dilution, etc. may be observed readily.

Preferred Embodiment 2

Figure 4:
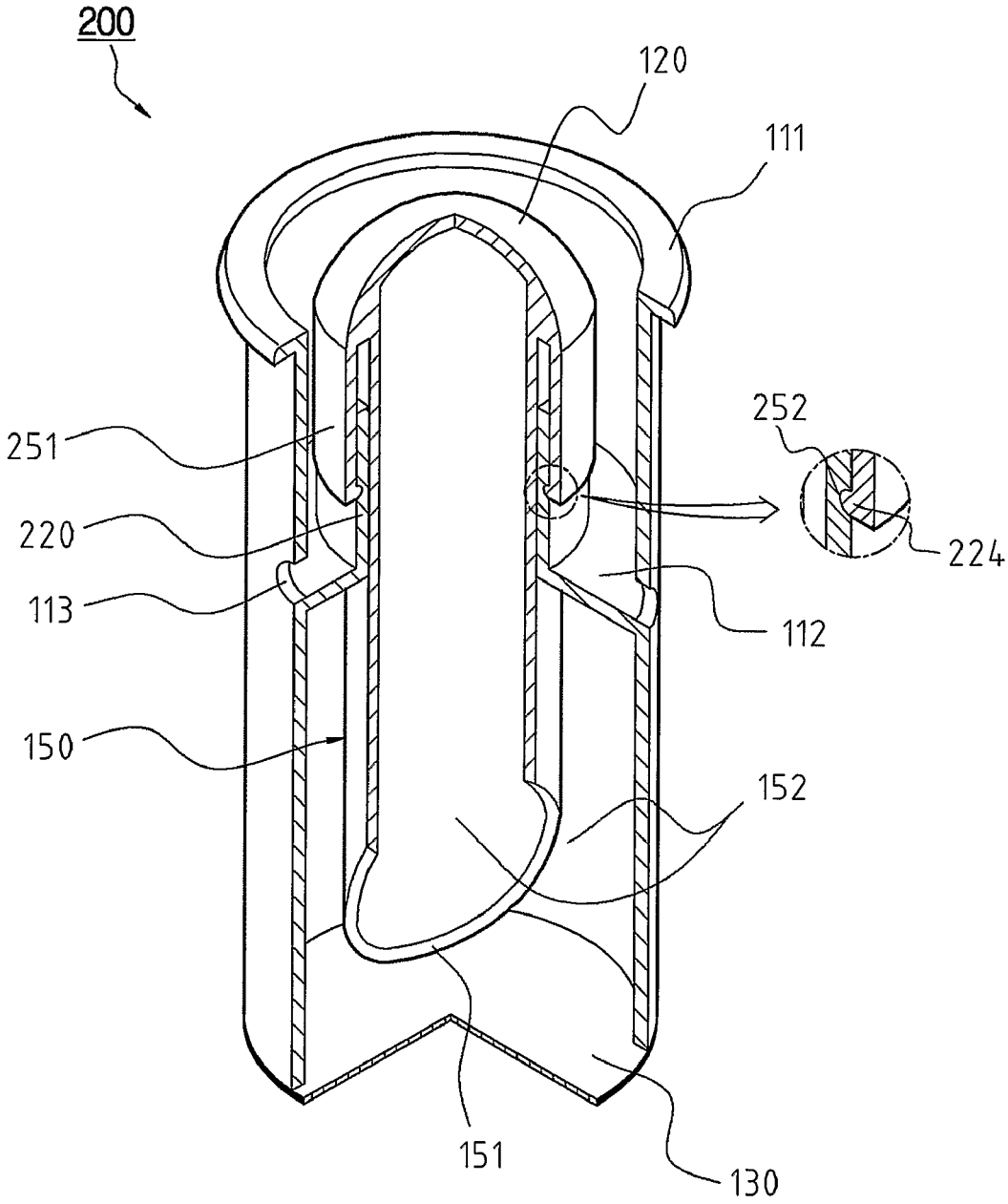
FIG. 4 is a partially sectional perspective view of a capsule container according to another preferred embodiment of the present invention.
Figure 5:
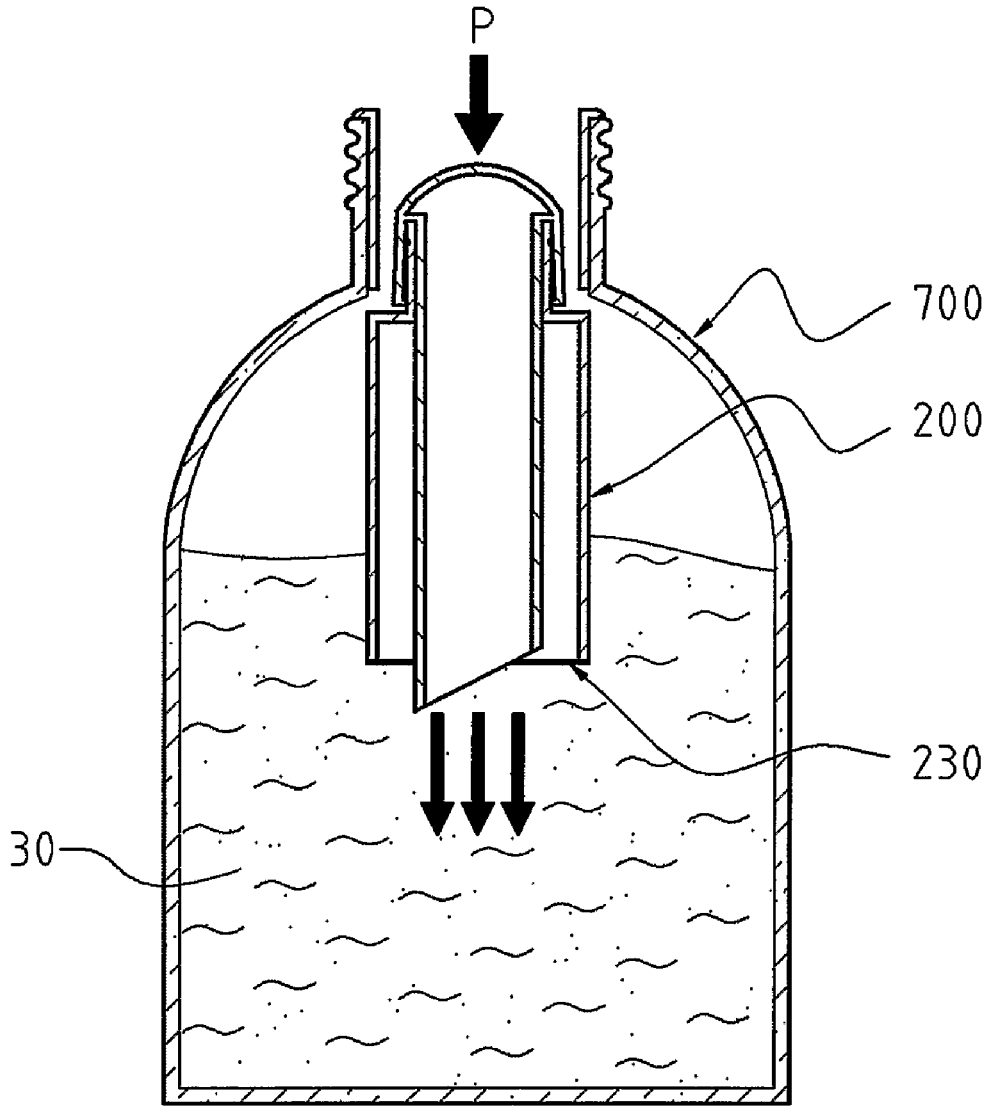
FIG. 5 is a cross-sectional view of the capsule container shown in FIG. 4 when it is used.

FIG. 4 is a partially cross-sectional view of a capsule container 200 according to another preferred embodiment of the present invention. FIG. 5 is a cross-sectional view of the capsule container 200 shown in FIG. 4 when it is used.

Referring now to FIGS. 4 and 5, the capsule container 200 is briefly constructed to have a receiving member 110, a pressing member 120 formed on the upper side which is slided and inserted in the receiving member 110, a vertically movable member 150 installed under the pressing member 120, and a shielding membrane 130 finishing the lower end of the receiving member 110.

More concretely, the receiving member 110 has a similar structure to that of Preferred Embodiment 1, and is characterized by being equipped with a partition 112 dividing the receiving member 110 into upper and lower portions, a hollow portion vertically penetrating through the central part of the partition 112, a cylindrical guide member 220 extended upwardly from the inner periphery of the partition 112, and a shielding membrane 130 attached to the lower side of the receiving member 110.

In the meantime, the vertically movable member 150 has a point 151 at its lower side, and is inserted into the hollow portion to be able to move up and down. That is, the upper side of the vertically movable member 150 is equipped with a guide end 251 having the same shape and inner diameter as the shape and outer diameter of the guide member 220. As shown in FIG. 4, the outer periphery and inner periphery of the guide member 220 come in contact tightly with each other by the guide end 251 and the outer periphery of the vertically movable member 150, and therefore, the guide member is not released from the guide end and the vertically movable member and the up-and-down movement is performed stably.

It is preferable that a concave portion 252 and the corresponding convex portion 224 are constructed on a portion where the inner periphery and the outer periphery of the vertically movable member 150 and guide member 220 are coupled when the vertically movable member 150 is slided to the top of the guide member 220 so that the downward sliding movement according to the concave-convex combination is suppressed.

The operational effects of capsule containers will now be illustrated concretely below:

As described in Preferred Embodiment 1, the user drinks the content accommodated in the bottle 700, and applies a fixed amount of pressure P to the upper side of the pressing member 120. The applied pressure P refers to a force as strong as that can release the combination between the concave portion 252 and the convex portion 224. If the pressure P is applied to the pressing member 120, the combination of the concave and convex portions 252 and 224 is released elastically, and the outer periphery of the vertically movable member 150 and the inner periphery of the guide end 251 move down along the inner and outer peripheries of the guide member 220. When the point 151 provided on the lower end of the vertically movable member 150 reaches the shielding membrane 130 finishing the lower end of the receiving member 110, it breaks the receiving member 110. Then, the content contained in the space part 152 of the capsule container 200 flows into the bottle 700 to produce a mixture 30 as described in the above.

Therefore, the capsule container of this preferred embodiment has an advantage that the vertically movable member is comprised of two components enabling a stable sliding movement, rather than an integral construction, as shown in the above Preferred Embodiment 1.

The principle of drinking hereinafter is the same as that of Preferred Embodiment 1, and therefore, its detailed illustration is omitted here.

Preferred Embodiment 3

Figure 6:
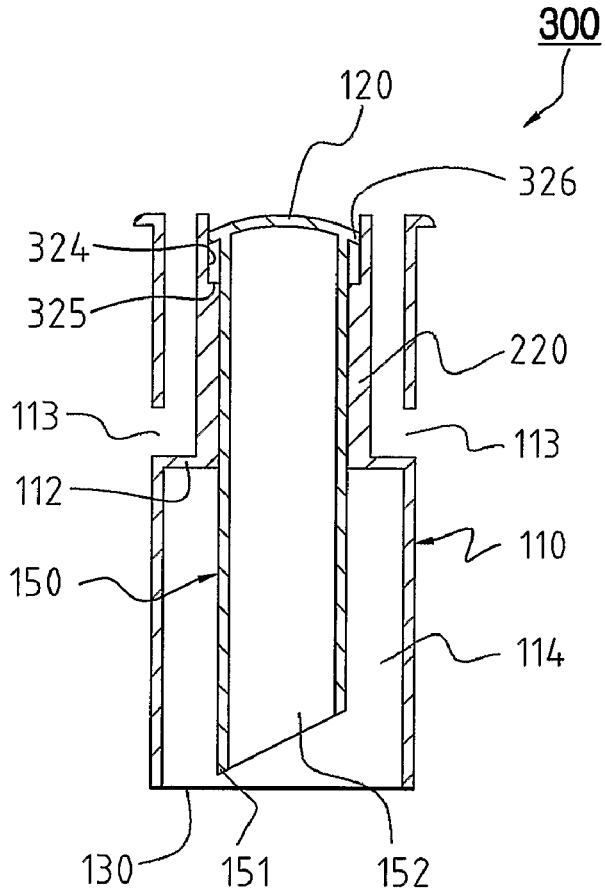
FIG. 6 is a cross-sectional view of a capsule container according to still another preferred embodiment of the present invention.

FIG. 6 is a cross-sectional view of a capsule container 300 according to still another preferred embodiment of the present invention, which shows modified designing and construction of a capsule container in the above Preferred Embodiment 2.

The capsule container shown in FIG. 6 has a similar construction to that of Preferred Embodiment 2, provided that the upper side of the guide member 220 is cut to have fixed thickness and depth, and therefore, an enlarged end 324 having an extended inner diameter as well as a stepped portion 325 having the shape of a locking portion are formed on the enlarged end 324 and the lower part of the enlarged end 324.

The pressing member 120 further includes a locking portion 326 which is horizontally extended from the upper side of the pressing member, where the locking portion 326 has the same size as that of the enlarged end 324. When the pressing member 120 and vertically movable member 150 break the shielding membrane 130 by the point 151, the locking portion 326 is caught and supported by the stepped portion 325 thus suppressing the downward movement and preventing breakaway.

And if the manufacturer desires to choose, a return spring (not shown) may be installed at the inside of the enlarged end 324, i.e., between the locking portion 326 and the stepped portion 325, so that the integrated pressing member 120 and vertically movable member 150 return elastically to the original upward position after the shielding membrane 130 is broken.

Accordingly, it is possible to have a stable up-and-down sliding movement even if the construction of the guide end 251 disclosed in Preferred Embodiment 2 is omitted.

Preferred Embodiment 4

Figure 7:
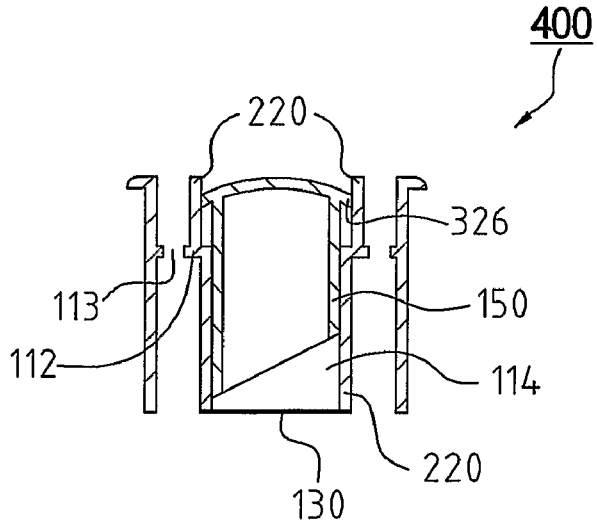
FIG. 7 is a cross-sectional view of a capsule container according to yet another preferred embodiment of the present invention.

FIG. 7 is a cross-sectional view of a capsule container 400 according to yet another embodiment of the present invention, which shows the formation of a multiple number of discharging ports 113 on the partition 112.

FIG. 7 shows a construction to which a part of the construction of the vertically movable member 150 and guide member 220 in Preferred Embodiment 3 disclosed in the above is applied besides the construction of the above discharging ports 113.

In more detail, constructed on the upper side of the pressing member 120 are a cylindrical guide member 220 protruded from the upper and lower sides of the partition 112, and a locking portion 326 horizontally extended from the upper side of the pressing member 120, where the locking portion 326 has the same diameter as that of the inner periphery of the guide member 220.

The guide member 220 protruded downwardly from the bottom side of the partition 112 has an inner periphery that comes in contact with the outer periphery of the vertically movable member 150. The guide member has the same height as that of the lower side of the receiving member 110, and the lower side of the guide member is finished by the shielding membrane 130.

Therefore, in principle, the outer periphery of the locking portion 326 and the vertically movable member 150 are slidably guided by the inner periphery of the guide member 220 protruded upwardly from the upper side of the partition 112. When the vertically movable member 150 reaches the lower portion, it is supported on the guide member 220 and the partition 112.

Before the locking portion 326 is caught and supported by the partition 112, the shielding membrane 130 is broken by the vertically movable member 150 enabling the blending operation of contents as described in the above.

Also, as in Preferred Embodiment 3, a return spring (not shown) may be installed inside of the enlarged end 324, i.e., between the locking portion 326 and the corresponding partition 112, to return the pressing member 120 and the vertically movable member 150 to the original position after the shielding membrane 130 is broken.

Preferred Embodiment 5

Figure 8:
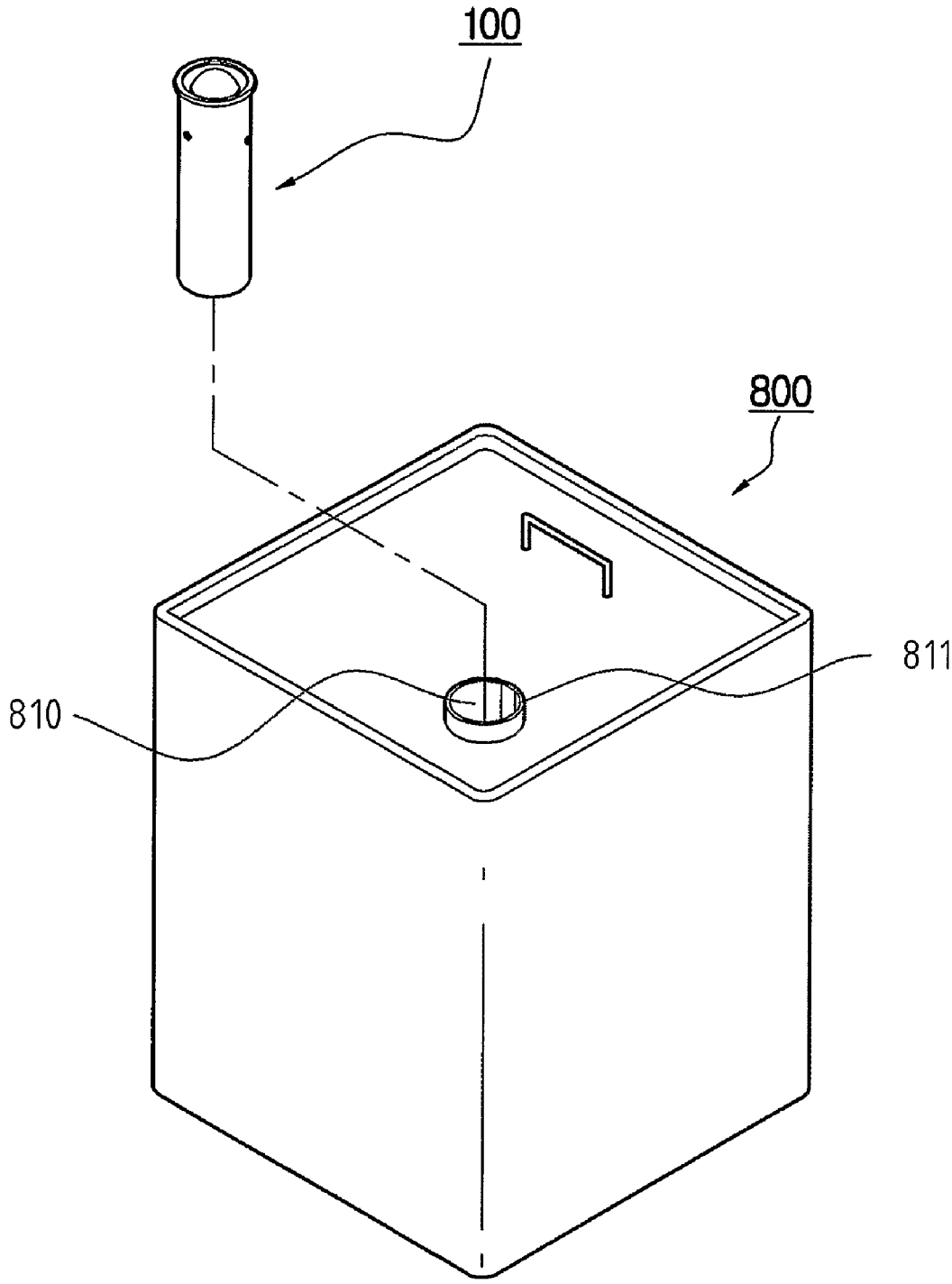
FIG. 8 is a disassembled perspective view of a capsule container of the present invention applied to a bucket container.

FIG. 8 is a disassembled perspective view of any one of the capsule containers 100, 200, 300, and 400 of the present invention applied to a bucket container 800, in which the capsule containers disclosed in Preferred Embodiments 1 through 4 are inserted in and supported by the bucket container 800 accommodating a paint or the like to prevent flowing-out and splashing of the content, flowing-out of foams, etc. when opening the cover (not shown).

The capsule containers 100, 200, 300, and 400 are implemented in the form of modules, and therefore, various kinds of contents to be used by the user may be offered to the user in the state that they are accommodated in the space part of the capsule container.

In case of a paint, for example, after the user uses a desired amount of the paint from the bottle at ordinary times, when the paint is consumed to have a proper amount or as intended by the user, the capsule container having a thinner, water, etc. accommodated may be operated in order to dilute the paint with a thinner, water, etc. Of course, since the capsule container accommodating water, a thinner, etc. can be purchased separately, the capsule container having the contents completely discharged is separated from the bucket container 800, after which a new capsule container accommodating a solvent (such as a thinner, water, etc.) is inserted into the receiving member 110 through the opening 810, and its rim 811 is caught and supported by the locking portion 111 of the receiving member 110, so that the dilution operation is facilitated by a desired amount of the thinner or water. Accordingly, it is not necessary for the user to be equipped with separate solvents, etc., and the user can carry out the painting work at any time and place.

Preferred Embodiment 6

The capsule container according to the present invention may be utilized in the form that the original solutions of agricultural chemicals, solvents in which the original solutions of agricultural chemicals are diluted, etc., instead of the paint or solvent shown in Preferred Embodiment 5.

Conventionally, the original solutions of agricultural chemicals have been accommodated and circulated in glass bottle containers. Therefore, there have been problems of causing serious social phenomena such as poisoning by agricultural chemicals, etc., since it has been difficult to handle agricultural chemicals, and harmful materials such as heavy metals, etc. contained in the original solutions of agricultural chemicals have had to be exposed to atmosphere when they have been diluted with solvents.

Whereas, the capsule container according to the present invention is manufactured in the form that the original solutions of agricultural chemicals and solvents are accommodated selectively, and therefore, is advantageous in that the original solutions of agricultural chemicals are not exposed to atmosphere even after the dilution of the solvent and the original solution of the agricultural chemical is begun.

Also, as shown in Preferred Embodiment 5, since the capsule container accommodating the original solutions of agricultural chemicals and solvents separately is manufactured in the form of modules, there is an advantage of facilitating carrying of the capsule container and the dilution work as it becomes possible to dilute an agricultural chemical having a desired degree of dilution by simply carrying such capsule container.

While the present invention has been described and illustrated herein with reference to the preferred embodiments thereof, it will be apparent to those skilled in the art that various modifications and variations can be made therein without departing from the spirit and scope of the invention. For example, some components of the Preferred Embodiments 1 through 4 may be selectively combined, which belongs to the scope of the present invention. Thus, it is intended that the present invention covers the modifications and variations of this invention that come within the scope of the appended claims and their equivalents.

INDUSTRIAL APPLICABILITY

As described in the above, the capsule container according to the present invention may be applied to various containers such as beverage containers, bucket containers, etc. The capsule container enables blending of not only fluids but also particles, solids, etc. The capsule container can effectively use two contents by being operated in such a way that the content accommodated in the beverage container or bucket container is drunk or withdrawn at ordinary times, while the content accommodated in the capsule container is mixed with the content stored in the above beverage container or bucket container as intended by the user.

Further, the capsule container is advantageous in that it may be used safely since the content does not splash or flow out when the cap of the beverage container or bucket container is open, or when drinking or withdrawing the content from the container.

Still further, the present invention is a very useful invention in that the capsule container is manufactured in the form of modules, and therefore, it is possible to blend the contents in one or more capsule containers with the contents accommodated in the beverage container and/or bucket container at a specific ratio as intended by the manufacturer.

The invention claimed is:

1. A capsule container comprising:

a cylindrical receiving member having both ends open, and a first locking portion horizontally extending from an upper side of said cylindrical receiving member, wherein said first locking portion is configured to hang from a top opening of a container;

a partition extended inwardly from a portion of an inner periphery of said cylindrical receiving member to divide said cylindrical receiving member into upper and lower portions, wherein a hollow portion vertically penetrating through a central part of said partition is formed inside of the cylindrical receiving member;

a cylindrical guide member extended upwardly from said partition or an inner periphery of said hollow portion, wherein said cylindrical guide member comprises an enlarged end having an extended inner diameter, as an upper side of said enlarged end has a fixed thickness, a fixed height and a stepped portion;

one or more discharging ports penetrating at regular intervals through said partition or a side wall of said cylindrical receiving member located above said partition;

an inverted-cup-shaped pressing member extended upwardly from a portion of said partition to have a fixed length;

a vertically movable member extended downwardly from an inside upper side of said pressing member to have a fixed length and having a point at a lower end, wherein said vertically movable member is a separate entity from said cylindrical receiving member, inserted into said hollow portion of the partition, supported by the cylindrical guide member to enable up-and-down sliding, formed in a half-opened shape and equipped with the pressing member on the upper side thereof;

a guide end of said vertically movable member equipped with said pressing member, the guide end being extended downward to have a same shape and diameter as an outer periphery of said cylindrical guide member, so that an inner periphery of said pressing member comes into contact with said outer periphery of said cylindrical guide member, wherein said pressing member comprises a second locking portion caught and supported by said stepped portion of said cylindrical guide member during downward movement, as said upper side of said pressing member is horizontally extended in a same size as that of said enlarged end; and a shielding membrane finishing the lower side of said cylindrical receiving member.

2. The capsule container of claim 1, characterized by that a portion of said pressing member encountered with said vertically movable member is made of a material selected from the materials having a fixed amount of elastic stability.

3. The capsule container of claim 1, characterized by that a graduated gauge that enables recognition of an amount of a content of said cylindrical receiving member is on an outer periphery of said cylindrical receiving member.

4. The capsule container of claim 2, characterized by that said partition is curved and streamlined from said discharging ports.

5. The capsule container of claim 2, characterized by that said vertically movable member has an inverted cup shape with the lower side open and the other side closed thus forming a space part inside and said point at the lower end.

6. The capsule container of claim 2, characterized by that an inner periphery of said guide end or an outer periphery of said vertically movable member is equipped with a concave portion, and the corresponding outer periphery of said vertically movable member or inner periphery of said guide member is equipped with a convex portion, the corresponding concave and convex portions forming a concave-convex combination.

7. The capsule container of claim 1, characterized by that said shielding membrane is thin-filmed aluminum or one or more materials selected from synthetic resins, or one or more synthetic resins layered.

8. The capsule container of claim 1, characterized by that one or more solid powder, liquids, and gases having different components are accommodated selectively in a space part between said portion of said receiving member and said shielding membrane.

9. The capsule container of claim 3, characterized by that an inner periphery of said guide end or an outer periphery of said vertically movable member is equipped with a concave portion, and the corresponding outer periphery of said vertically movable member or inner periphery of said guide member is equipped with a convex portion, the corresponding concave and convex portions forming a concave-convex combination.

10. The capsule container of claim 2, characterized by that said shielding membrane is thin-filmed aluminum or one or more materials selected from synthetic resins, or one or more synthetic resins layered.

11. The capsule container of claim 3, characterized by that said shielding membrane is thin-filmed aluminum or one or more materials selected from synthetic resins, or one or more synthetic resins layered.

12. The capsule container of claim 4, characterized by that said shielding membrane is thin-filmed aluminum or one or more materials selected from synthetic resins, or one or more synthetic resins layered.

13. The capsule container of claim 5, characterized by that said shielding membrane is thin-filmed aluminum or one or more materials selected from synthetic resins, or one or more synthetic resins layered.

14. The capsule container of claim 2, characterized by that one or more solid powder, liquids, and gases having different components are accommodated selectively in a space part between said portion of said receiving member and said shielding membrane.

15. The capsule container of claim 3, characterized by that one or more solid powder, liquids, and gases having different components are accommodated selectively in a space part between said portion of said receiving member and said shielding membrane.

16. The capsule container of claim 4, characterized by that one or more solid powder, liquids, and gases having different components are accommodated selectively in a space part between said portion of said receiving member and said shielding membrane.

17. The capsule container of claim 5, characterized by that one or more solid powder, liquids, and gases having different components are accommodated selectively in a space part between said portion of said receiving member and said shielding membrane.

* * * * *